United States Patent [19]

Loyd, Jr.

[11] 3,990,818

[45] Nov. 9, 1976

[54] LUBRICATION SYSTEM FOR ROTARY PISTON MECHANISMS

[75] Inventor: Robert W. Loyd, Jr., Wyckoff, N.J.

[73] Assignee: Curtiss-Wright Corporation, Wood-Ridge, N.J.

[22] Filed: Feb. 12, 1976

[21] Appl. No.: 657,490

Related U.S. Application Data

[63] Continuation of Ser. No. 553,745, Feb. 27, 1975, abandoned.

[52] U.S. Cl. ..... 418/87; 418/88; 418/97

[51] Int. Cl.[2] ..... F01C 21/04; F04C 29/02

[58] Field of Search ..... 418/88, 97–99, 418/87; 123/8.01; 184/6.5

[56] References Cited

UNITED STATES PATENTS

| | | | |
|---|---|---|---|
| 1,509,917 | 9/1924 | Westinghouse | 418/97 |
| 1,568,391 | 1/1926 | Young | 123/8.39 |
| 3,420,214 | 1/1969 | Bensinger et al. | 418/97 |
| 3,771,903 | 11/1973 | King et al. | 418/98 |
| 3,809,021 | 5/1974 | Lamm | 418/97 |
| 3,820,923 | 6/1974 | Zweifel | 418/99 |
| 3,844,691 | 10/1974 | Dobler | 418/97 |

*Primary Examiner*—John J. Vrablik

*Attorney, Agent, or Firm*—Arthur Frederick; Victor D. Behn

[57] ABSTRACT

The lubrication system for rotary mechanisms of the Wankel type, having a housing in which a rotor planetates, comprises an elongated, shallow trough in the inner peripheral surface of the trochoid housing of the mechanism, which trough extends substantially across the entire width of the surface and with its longitudinal axis canted relative to the trace line of the inner peripheral surface. A supply means is provided to conduct metered amounts of lubricant to the trough from a suitable source of lubricant to fill and maintain the trough in a full condition so that the apex seal blade carried by the rotor picks-up and distributes lubricant along the inner peripheral surface.

9 Claims, 5 Drawing Figures

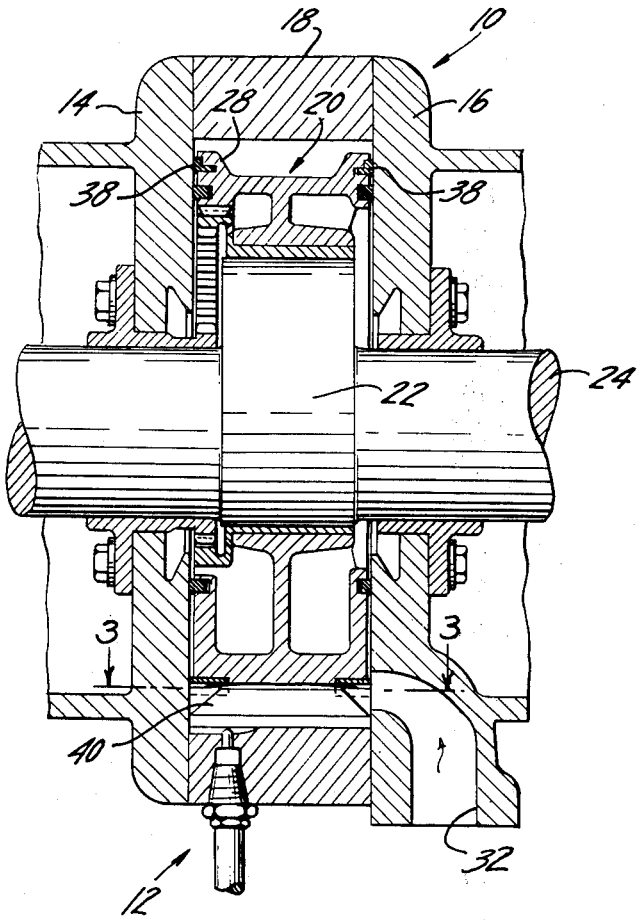
FIG. 2
FIG. 4
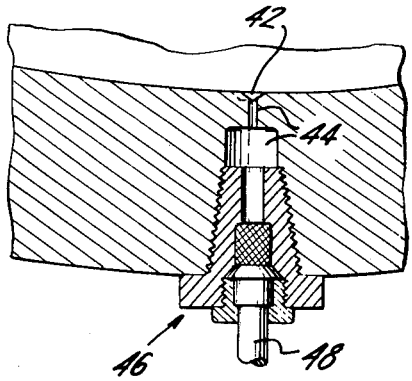
FIG. 3
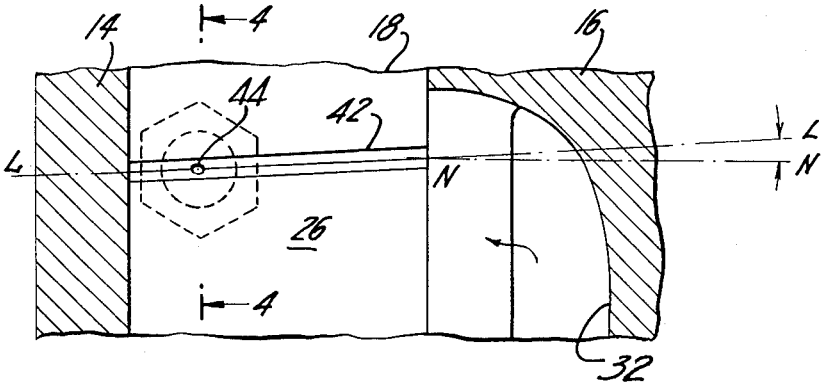
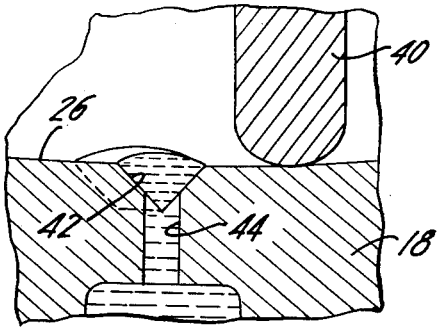
FIG. 5

LUBRICATION SYSTEM FOR ROTARY PISTON MECHANISMS

This is a continuation of application Ser. No. 553,745, filed Feb. 27, 1975, now abandoned.

This invention relates to rotary mechanisms of the Wankel type and, more specifically, to a lubrication system for lubricating the inner surfaces of the housing components of Wankel type mechanisms.

BACKGROUND

It is well known that it is necessary in a rotary mechanism of the Wankel type, such as disclosed in the U.S. Patent to Wankel et al., U.S. Pat. No. 2,988,065 to lubricate the inner housing wall surfaces, particularly the inner trochoidal surface which defines with end wall surfaces a cavity within which a rotor rotates, the inner trochoidal surface being a surface against which bear apex seals carried by the rotor. To minimize frictional wear of the apex seals and the inner trochoidal surface and to provide improved sealing, various lubricating systems have been devised such as are exemplified in the following U.S. patents:

| | |
|---|---|
| Scherenberg | 3,193,053 |
| Bentele | 3,245,386 |
| Bensinger et al | 3,420,214 |
| King et al | 3,771,903 |
| Lamm | 3,809,021 |
| King | 3,811,806 |
| Casey | 3,814,555 |
| Dobler | 3,844,691 |

None of these known lubricating systems has proven entirely satisfactory, primarily for the reason that none of the systems insure lubrication across the entire width of the inner trochoidal surface and, in some instances, are uneconomical with regard to oil consumption; as for example, where the oil is entrained in the fuel or air entering the working chambers. The improved lubrication system according to this invention overcomes these and other disadvantages of heretofore known lubrication systems.

Accordingly, it is an object of this invention to provide an improved lubrication system for a rotary mechanism of the Wankel type which insures distribution of lubricant across the entire width of the inner trochoidal surface. It is another object of the present invention to provide an improved lubrication system in which oil consumption is minimized.

SUMMARY

The invention therefore contemplates an improved lubrication system for a rotary mechanism of the Wankel type, which mechanism comprises a housing having an inner peripheral wall surface of trochoidal shape and end walls defining with the inner peripheral wall surface a cavity within which a rotor is supported for planetary rotation and which rotor defines with the housing a plurality of working chambers. Each of the working chambers successively expand and contract in volumetric size as the rotor planetates within the housing cavity. To isolate one working chamber from the other, the rotor carries sealing devices, including apex seals, which engage and follow the trace of the inner peripheral wall surface.

The improved lubrication system comprises an elongated shallow recess in the inner peripheral wall surface extending substantially across the entire width of the inner peripheral wall and a supply means for communicating the recess with a source of lubricant and maintaining the recess filled with lubricant. The recess is so positioned that its longitudinal axis is canted relative to a normal line extending normal to an imaginary line following the trace of the inner peripheral wall surface. This canted orientation of the recess is for the purpose of effecting displacement of a portion of the lubricant in the recess from one end of the recess to the other end and ensuring thereby distribution of lubricant across the entire width of the inner peripheral wall surface. Another purpose of this canted disposition of the recess is to minimize gas leakage past the apex seal (blow-by). It is preferred that this canted angle be between about 5° to about 60°, the angle being selected on a basis of recess width, apex seal tip speed and other features and operating characteristics of the particular mechanism. The recess is located in the inner peripheral wall surface at a point where temperatures and pressures are relatively low and the lubricant will fill the recess and remain in the recess until displaced and picked-up by the apex seals to wet thereby the inner peripheral wall surface.

DESCRIPTION OF THE DRAWINGS

The invention will be more clearly understood from the following detailed description thereof when considered in connection with the accompanying drawings wherein one embodiment of the invention is illustrated by way of example and in which:

FIG. 2 is a cross-sectional view taken substantially along line 2—2 of FIG. 1;

FIG. 3 is a fragmentary view in cross-section taken substantially along line 3—3 of FIG. 2 and shown on an enlarged scale;

FIG. 4 is a fragmentary cross-sectional view taken along line 4—4 of FIG. 3; and FIG. 5 is a fragmentary enlargement of the lubricant trough according to this invention.

DESCRIPTION OF PREFERRED EMBODIMENT

Figure 1:
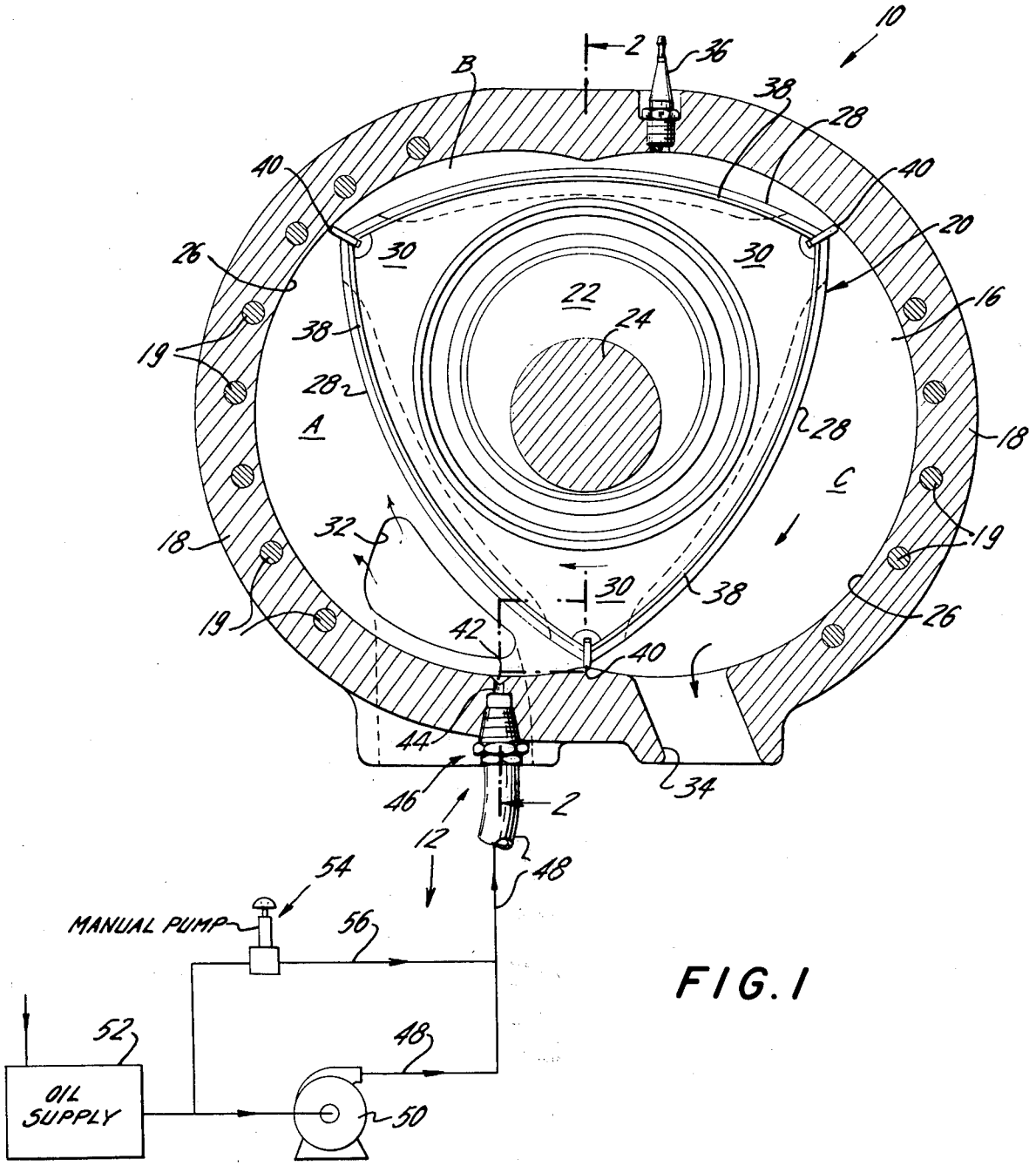
FIG. 1 is a transverse sectional view through a rotary mechanism of the Wankel type in which is provided an improved lubrication system according to this invention.

Now referring to the drawings and more specifically to FIGS. 1 and 2, the reference number 10 generally refers to a rotary mechanism of the Wankel type which may, as shown, be an internal combustion engine and which has an improved lubricant system 12 according to this invention.

The rotary mechanism 10 as illustrated in FIGS. 1 and 2 has a housing which comprises two end walls 14 and 16 spaced apart by a peripheral wall 18. The walls are suitably secured together by tie bolts 19 to define a cavity within which a rotor 20 is supported for planetary rotation on an eccentric portion 22 of a mainshaft 24. The peripheral wall 18 has an inner surface 26 which is of epitrochoidal configuration and forms a two lobe housing cavity. The rotor 20 is of generally triangular configuration so as to have three flank portions 28 which converge at apex portions 30. The rotor 20 defines, with inner peripheral wall surface 26 and the inner surfaces of end walls 14 and 16, a plurality of working chambers A, B and C, each of which chambers successively expand and contract in volumetric size as rotor 20 planetates within and relative to the housing cavity. A fuel and air intake port 32 is provided in end wall 16 to receive a fuel-air mixture from a suitable source thereof, such as a carburetor (not shown) and pass the same into working chamber A. An exhaust port 34 is provided in peripheral wall 18 to pass spent combustion products from working chamber C. To achieve ignition and combustion of the compressed fuel-air mixture in working chamber B, an ignition means, such as a spark plug 36, is secured in peripheral wall 18. To isolate working chambers A, B and C from each other, rotor 20 carries gas seal strips 38 in the opposite end faces of the rotor which coact with apex seals 40 disposed in each of the apex portions 30 of the rotor.

The internal combustion engine 10 operates on the four stroke Otto cycle principle and, therefore, each of the working chambers A, B and C goes through the conventional four phases of operation; namely, suction, compression, expansion and exhaust. More specifically, fuel and air mixture is drawn into a working chamber through intake port 32 during the suction phase as the working chamber in communication with the intake port 32 increases in volumetric size. The fuel-air mixture is then compressed as the working chamber decreases in volumetric size and, when substantially compressed as shown in chamber B, the fuel-air mixture is ignited causing the gases to expand and forcing the rotor to rotate during this expansion phase. After the expansion phase, the working chamber decreases in volumetric size to exhaust the spent combustion products from the working chamber through exhaust port 34. To minimize the frictional engagement of apex seals 40 against inner peripheral surface 26 and to enhance the sealing effectiveness of the apex seals 40, the improved lubrication system 12 according to this invention is provided for engine 10.

As best shown in FIGS. 3 and 4, the lubrication system 12 comprises a shallow, elongated recess, depression or trough 42 in the inner peripheral surface 26 of wall 18. The trough 42 extends substantially across the entire width of surface 26 with the longitudinal axis L—L thereof canted relative to a line N—N extending normal to the end surface of peripheral wall 18 or a trace line of inner surface 26. The trough 42 may be V-shaped in cross section as shown, or be of other suitable cross sectional configuration. A lubricant supply means, including a passageway 44 in peripheral wall 18 and a connector 46 for securing a supply conduit 48 to peripheral wall 18 in communication with passageway 44, is provided to deliver liquid lubricant, such as oil, to trough 42. The passageway 44 preferably communicates with trough 42 at one portion of the trough. As shown in FIG. 1, the supply means may also include a metering pump 50 connected to supply conduit 48 to deliver precise quantities of lubricant to the latter from a source 52 thereof, such as a reservoir, sump or the like. The metering pump 50 may be of the type disclosed in U.S. Patents to Corwin U.S. Pat. No. 3,639,082 and Woodier U.S. Pat. No. 3,715,177 or any other suitable type. A manual pump 54 in a bypass pipe 56 may be provided for priming purposes or emergency use. The trough 42 is located in peripheral surface 26 adjacent intake port 32 where the temperatures and pressures are relatively low. It is also located in relation to normal engine orientation so that the trough lies in a horizontal plane. The lubricant is metered at such a rate to trough 42 in relation to engine speed that the capillary action of the lubricant will tend to cause the lubricant to "puddle" in the trough as best illustrated in FIG. 5. With the puddle of lubricant in trough 42 extending across substantially the entire width of peripheral surface 26 and the displacement action of apex blades 40 of the lubricant from one end of trough 42 to the other, lubrication of the entire surface of peripheral surface 26 is assured. The angle of cant between lines N—N and L—L is selected within the range of about 5° to about 60° in accordance with degree of acceptable gas leakage past the apex seal 40 (blow-by), dimensions of trough 42, apex seal tip speed and other features and operating characteristics of the engine 10.

In operation of lubrication system 12, liquid lubricant is supplied to trough 42, via passageway 44, connector 46, pipe 46 and metering pump 50, at such a rate in relation to engine speed that the lubricant, as shown in FIG. 5, tends to puddle in trough 42. This lubricant extending slightly above the surface of peripheral surface 26 is contacted by each apex seal 40 as rotor 20 rotates within the mechanism housing and displaces the lubricant and smears it across the width and along the trace of peripheral surface 26. The canting of trough 42 and the lateral displacement action of the lubricant by the apex seals insures distribution of lubricant across the width of peripheral surface 26 even if puddling is not uniform.

It is believed now readily apparent that the present invention provides an improved lubricant system for a Wankel type mechanism which insures distribution of lubricant across the entire width of the trochoidal housing surface and, since lubricant is applied directly where it is needed, with minimal consumption of lubricant.

Although but one embodiment has been illustrated and described in detail, it is to be expressly understood that the invention is not limited thereto. Various changes can be made in the arrangement of parts without departing from the spirit and scope of the invention as the same will now be understood by those skilled in the art.

What is claimed is:

1. In a rotary mechansim of the type comprising a housing having an inner peripheral wall surface of trochoidal shape and end walls defining with said inner peripheral wall surface a cavity therebetween and having a rotor supported for eccentic rotation within the cavity and defining with said housing walls a plurality of working chambers, each of which successively expand and contract in volumetric size as the rotor rotates, the rotor having apex portions and sealing devices carried in the apex portion, an improved lubrication means for supplying lubricant to the inner peripheral wall for contact with said sealing devices comprising:

a. a source of lubricant;

b. an elongated, uninterrupted recess in said inner peripheral wall surface extending substantially across the entire width of said inner peripheral wall surface and with the longitudinal axis of the recess canted relative to a normal line to the imaginary line following the trace of said inner peripheral wall surfaces;

c. the recess being located to extend in a substantially horizontal plane in said peripheral wall surface that lubricant remains at the recess until contacted by the sealing devices; and d. a supply means communicating said source of lubricant with said recess to conduct lubricant to the latter in such amounts that a level of lubricant at said recess is above the peripheral wall surface for contact and removal by the sealing devices.

2. The apparatus of claim 1 wherein said recess is canted within the range of about 5° to about 60°.

3. The apparatus of claim 1 wherein said trough is relatively narrow and shallow.

4. The apparatus of claim 1 wherein said supply means communicates with said recess at the end portion of said recess first contacted by said apex sealing devices as the rotor rotates.

5. In a rotary mechanism of the type comprising a housing having an inner peripheral wall surface formed by a trochoidal trace and end walls defining a cavity therebetween and having a rotor supported for eccentric rotation within the cavity and defining with said housing walls a plurality of working chambers each of which successively expand and contract in volumetric size as the rotor rotates, the rotor having apex portions and sealing devices carried in the apex portion, an improved lubrication means for supplying lubricant to the inner peripheral surface for contact by the sealing devices comprising:

a. a source of lubricant;

b. an elongated relatively shallow and narrow, uninterrupted depression in said inner peripheral wall surface extending across substantially the entire width of said inner peripheral wall surface and with the longitudinal axis of the depression canted relative to a normal line to an imaginary line following the trace of said inner peripheral wall surface;

c. the recess being located to extend in a substantially horizontal plane in said peripheral wall surface that lubricant remains at the recess until contacted by the sealing devices;

d. said depression being canted at an angle within the range at about 5° to 60°; and e. a passageway means including a metering means for communicating said source of lubricant with the depression so as to supply such quantities of lubricant to said depression that the level of lubricant at the depression is above the peripheral wall surface for contact and removal by the sealing devices.

6. The apparatus of claim 5 wherein said passageway means communicates at the end portion of the depression which is first contacted by said apex sealing devices as the rotor rotates.

7. The apparatus of claim 6 wherein said rotary mechanism has an inlet port in at least one of said end walls and said depression is located in said inner peripheral wall surface adjacent said inlet port.

8. The apparatus of claim 6 wherein said depression is V-shape in cross section.

9. The apparatus of claim 6 wherein said depression is located in said inner peripheral wall where the temperatures and pressures in the working chambers is relatively low.

* * * * *